US005199674A

United States Patent [19]

Mihirogi

[11] Patent Number: 5,199,674

[45] Date of Patent: Apr. 6, 1993

[54] MULTI-ARTICULATION SWITCH

[75] Inventor: Kiyoshi Mihirogi, Odawara, Japan

[73] Assignee: HSST Corporation, Tokyo, Japan

[21] Appl. No.: 764,563

[22] Filed: Sep. 20, 1991

[30] Foreign Application Priority Data

Sep. 26, 1990 [JP] Japan ..... 2-256000

[51] Int. Cl.[5] ..... E01B 25/00; B61B 13/08

[52] U.S. Cl. ..... 246/434; 104/130.1

[58] Field of Search ..... 246/417, 418, 430, 434, 246/445, 446, 447; 104/96, 100, 101, 102, 103, 130, 130.1

[56] References Cited

U.S. PATENT DOCUMENTS

| | | | |
|---|---|---|---|
| 945,752 | 1/1910 | Butler et al. | 104/103 |
| 2,853,955 | 9/1958 | Bishop et al. | 104/103 X |
| 2,903,972 | 9/1959 | Schutze | 246/434 X |
| 3,093,090 | 6/1963 | Rosenbaum | 246/434 X |
| 4,016,818 | 4/1977 | Ellzey | 104/103 |
| 4,109,584 | 8/1978 | Mihirogi | 104/130 |
| 4,453,051 | 6/1984 | Brown | 104/130 X |
| 4,870,906 | 10/1989 | Schaffer et al. | 246/434 X |
| 4,993,326 | 2/1991 | Bergemann | 104/103 X |

FOREIGN PATENT DOCUMENTS

| | | | |
|---|---|---|---|
| 53-83211 | 7/1978 | Japan | 104/130.1 |
| 4136006 | 7/1978 | Japan | 104/130.1 |
| 5583620 | 7/1978 | Japan | 104/130.1 |
| 53-75607 | 10/1979 | Japan | 104/130.1 |
| 5375606 | 6/1980 | Japan | 104/130.1 |
| 6030801 | 10/1981 | Japan . | |
| 62-185919 | 8/1987 | Japan . | |

*Primary Examiner*—Michael S. Huppert
*Assistant Examiner*—Scott L. Lowe
*Attorney, Agent, or Firm*—Jordan and Hamburg

[57] ABSTRACT

A switch for connecting a main track girder selectively to any of a plurality of branch track girders includes a plurality of movable girders with articulations between adjacent movable track girders and between the main track girder and one of the movable track girders adjacent thereto, forming a stepped curve. The track girders have main rails fixedly secured thereon, respectively, for guiding a vehicle and for forming the stepped curve according to the arrangement of the main track girder and the movable track girders. A short intermedial rail is provided between the adjacent main rails. The short intermedial rails have both ends connected to the main rails on adjacent main track girders and adjacent movable track girders with relatively variable angles.

5 Claims, 4 Drawing Sheets

MULTI-ARTICULATION SWITCH

BACKGROUND OF THE INVENTION

1. Field of the Invention

The present invention relates to a multi-articulation switch and, particularly, to a multi-articulation switch for use with a magnetic levitating type linear motor car.

2. Description of the Prior Art

A magnetically levitating linear motor car is levitated and guided by a girder type track. As the girder for guiding such a car, a monorail car is known. In a conventional switch for such a monorail car, switching of the track between a plurality of branches is performed by turning a movable girder track portion around one end thereof which is rotatably connected to an end of a main stationary track. The movable girder track portion straight girder. In order to switch and guide the car between branch tracks smoothly by means of such a switch, it is often desirable for such a movable girder track portion to be curved. In order to respond to such a demand, bending of a rigid movable track within its elastic limit has been considered. However, in order to realize this, the movable track is sometimes too long.

SUMMARY OF THE INVENTION

An object of the present invention is to solve the above problem of the conventional switch by providing a switch capable of smoothly guiding a vehicle along a curved path.

Another object of the present invention is to form a smoothly curved path as short a switch girder as possible, by constructing it as if the movable girders were rotatably connected to each other.

A further object of the present invention is to provide a smoothly guiding a base structure for vehicle.

The above objects are achieved according to the present invention by providing a switch for connecting a fixed main track girder to any of a plurality of other fixed track girders, selectively, the switch being constructed with a plurality of movable track girders arranged such that adjacent movable track girders or a movable track girder and a fixed track girder adjacent thereto can form a curved path having articulation. Each of the movable track girders has a main rail for guiding a vehicle thereon, so that the main rails installed on the track girders form a curved path when the track girders form the curved path. A short auxiliary rail is provided between the adjacent main rails respectively installed on the movable track girders or the fixed track girder for coupling the main rails. Both ends of the auxiliary rail are formed to enable connection to the main rail, with a relative variable angle to the main rail on the movable track girder or the fixed track girder.

According to the present invention, the switch for switching a path between the main track and any of the branch tracks is constructed of a plurality of movable track girders which can be mutually bent at articulations. These movable track girders form an articulated path such that adjacent ones can be relatively articulated at an angle which is variable within a predetermined angle range.

Between the adjacent movable track girders or the fixed main track girder and the movable track girder adjacent thereto, these axes can be angled to each other within the predetermined angle range. With such angles at the articulations, the movable track girders can form an approximately curved path as a whole.

In order to provide a desired curved path with the movable track girders, the angle to be provided in each articulation has to have a certain extent which is not negligible depending on circumstances, since the number of articulations which are to be provided in the switch is necessarily limited. As a result, when the switch is constructed only with a plurality of movable track girders, the bend between the adjacent movable track girders or the fixed main track girder and the movable track girder adjacent thereto becomes strong, and so, a vehicle base structure, such as guide skid, may contact the main rail and/or movable track girders and/or brake shoes may collide with the main rails. Further, it is even possible that the main rails are deviated mutually at the articulation.

According to the present invention, these problems are solved by providing a short intermedial rail between main rails which are adjacent each other and fixed on the movable track girder or the fixed main track girder. The short intermedial rail has ends whose axes can make variable angles to the axes of the main rails on the girders (the fixed track girders or the movable track girders). In the simplest example, each end of the intermedial rail rotatably engages the main rail on the girder.

It is assumed that the movable track girder is so moved that the axis of the main rail on the girder and another axis of adjacent main rail on the movable or fixed track girder intersects in order to make on angle $\alpha$. Since there is the intermedial rail provided between the main rails of the adjacent track girders, such an angle is divided into two smaller angles. That is, there are provided two angles each of $\alpha/2$ between the main rail of a first one of the main track girders and the intermedial rail and between the intermedial rail and the main rail of a second one of the main track girders. Thus, the bending angle between adjacent main track girders is reduced, resulting in a smooth guiding of a vehicle over the articulation without any contact and/or collision of the vehicle base structure and/or brake shoes with the girder structure.

DETAILED DESCRIPTION OF THE PREFERRED EMBODIMENTS

Figure 3:
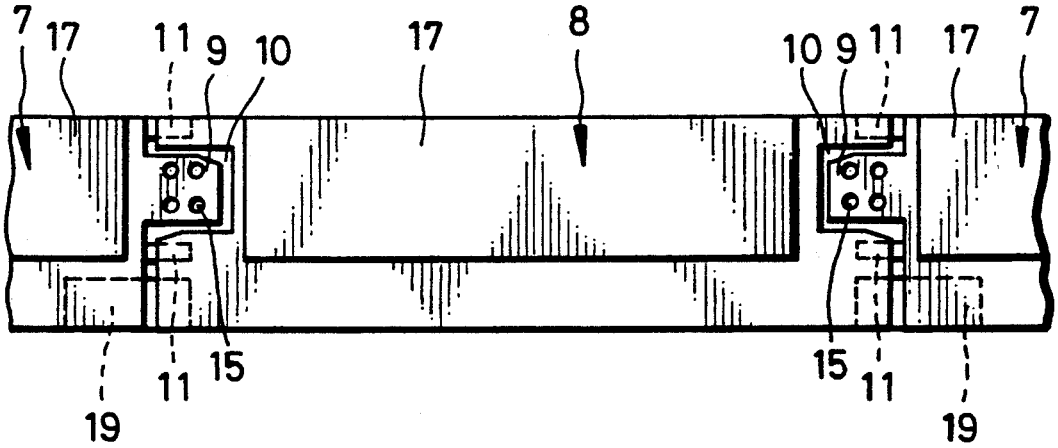
Figure 4:
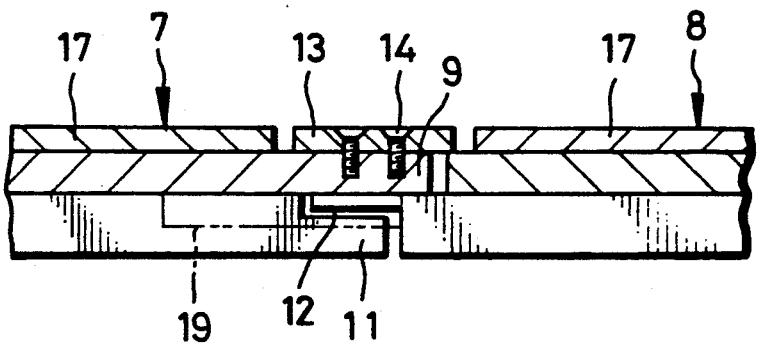
Figure 5:
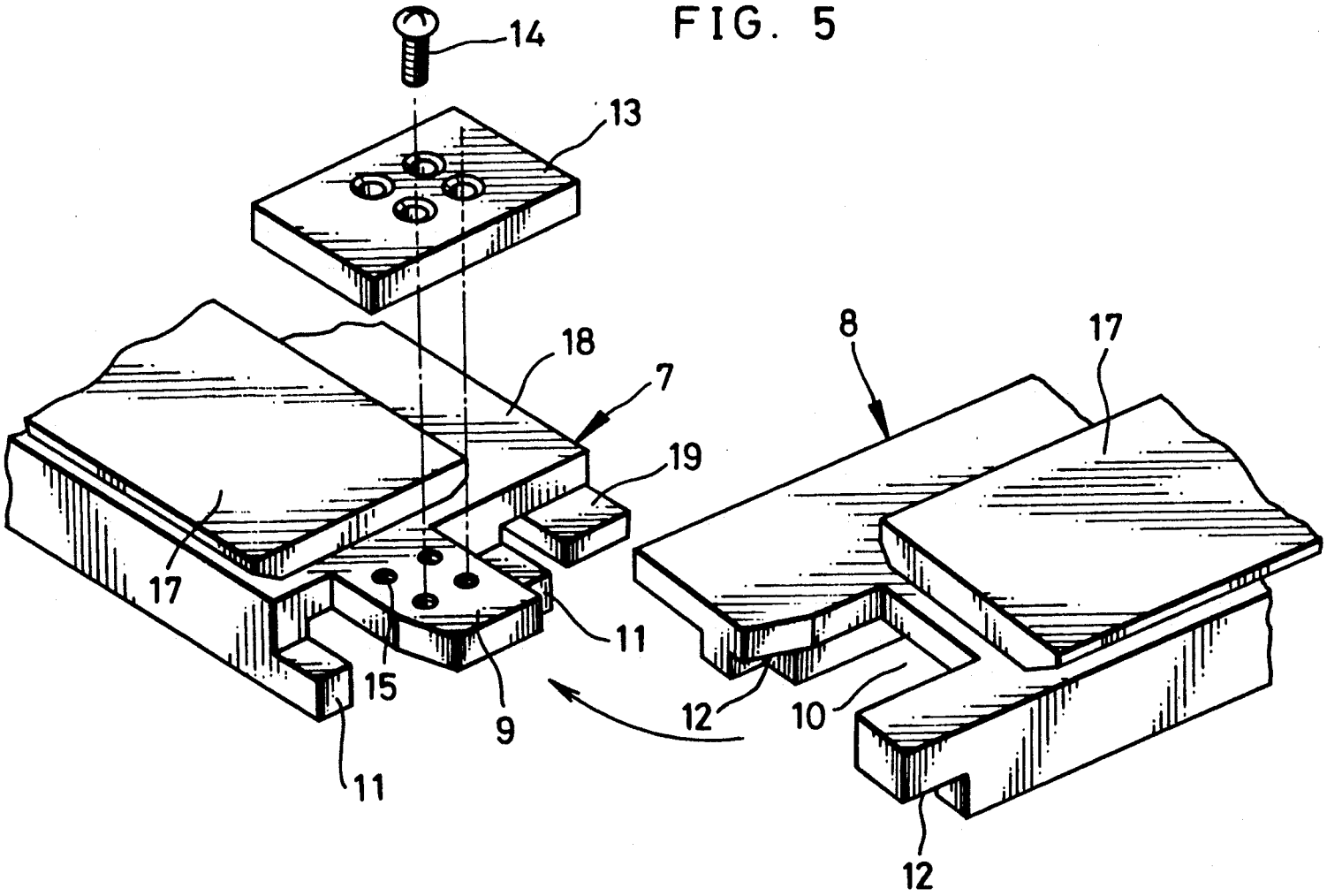
Figure 6:
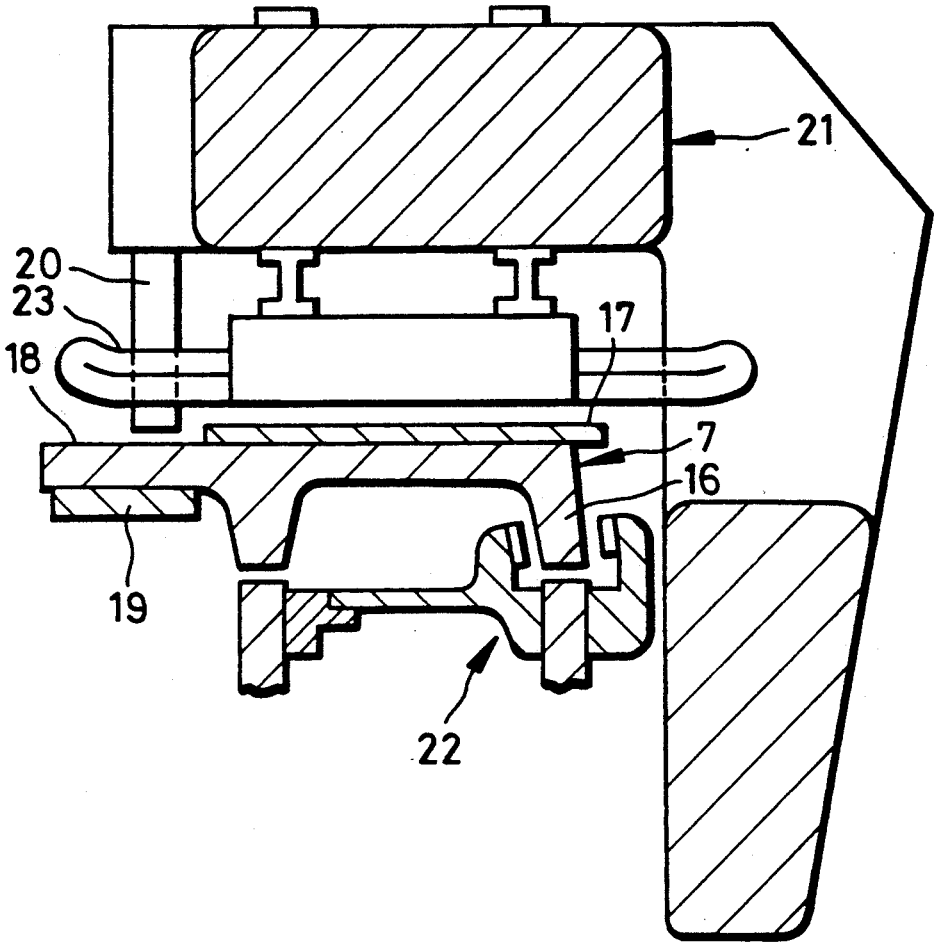

FIG. 3 a plan view showing an engagement of a main rail with an intermedial rail omitting a tie-plate;

FIG. 4 is a longitudinal cross section of the engagement with the tie-plate and a stop screw;

FIG. 5 is a prespective view showing a combination of the main rail and the intermedial rail;

FIG. 6 is a cross section of the main rail; and

Figure 7:
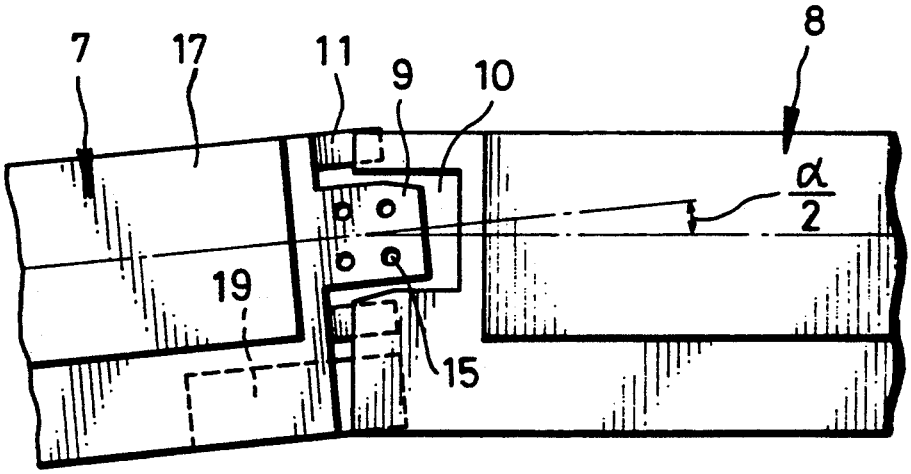

FIG. 7 is a plan view showing the engagement between the main rail and the intermedial rail when angled to each other.

Figure 1:
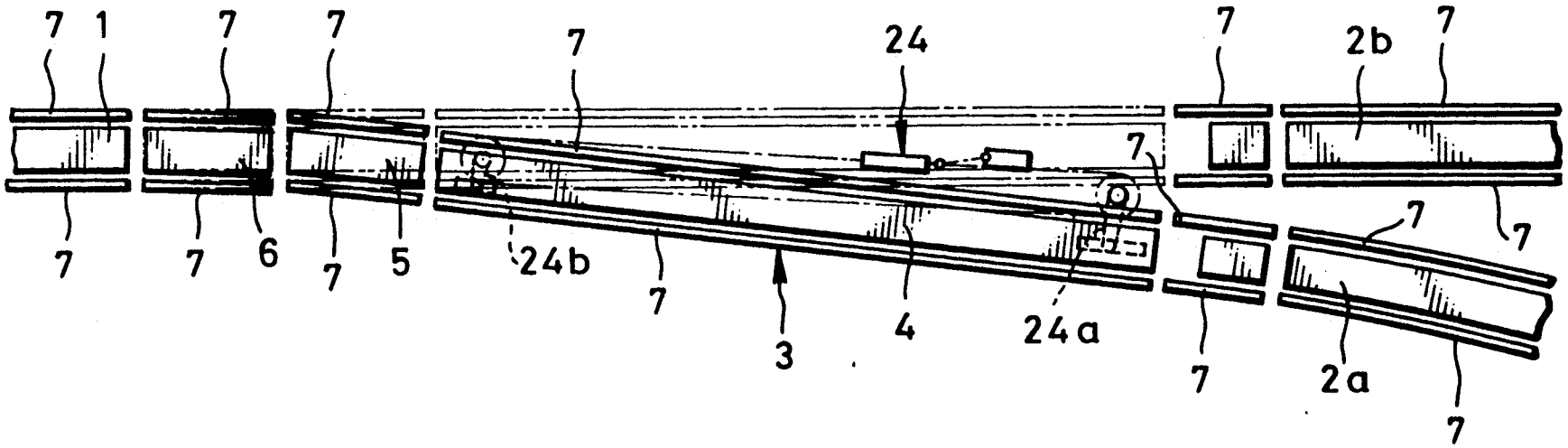
FIG. 1 is a schematic plan view of a switch track according to the present invention.

In FIG. 1, a switch for switching a fixed track girder, that is, a first fixed main track girder 1 to one of plurality of other fixed girders, that is, a second fixed girder 2*a* and a third fixed girder 2*b* includes a switch track girder 3. The switch track girder 3 can be switched between a first position at which the first fixed main track girder 1 is connected to the second fixed track girder 2*a* and the a second position at which the first fixed main track girder 1 is connected to the third fixed track girder 2b.

The switch track girder 3 is divided into a plurality of movable track girder, that is, a first movable track girder 4, a second movable track girder 5 and a third movable track girder 6. The third movable track girder 6 is rotatably connected to the fixed main track girder 1 and adjacent movable track girders 4, 5 and 6 are also suitably rotatably connected to each other. In this figure, the respective track girders 1 and 4 to 6 are mutually rotatably connected and when the first movable track girder 4 is moved by a driving means 24, more specifically by rotating crank levers 24a, 24b, all of other movalbe track girders 5 and 6 are switched synchronously.

The fixed track girders 1, 2a and 2b as well as the movable track girders 4, 5 and 6 are provided with main rails 7 fixed thereon, respectively.

Figure 2:
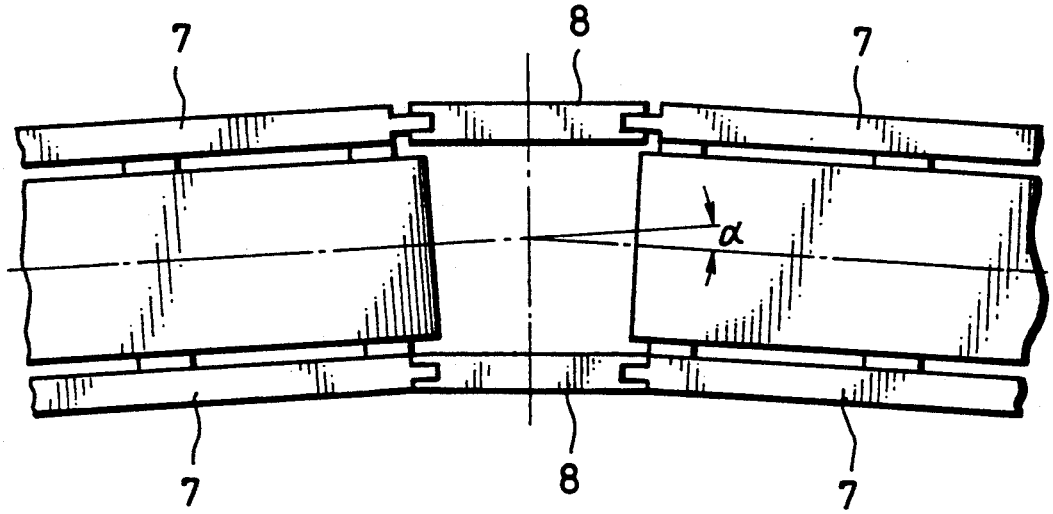
FIG. 2 is a schematic plan view exaggeratedly showing a construction of a track girder in a bent state.

By the switching operation of the switch track girder 3, the bends with certain angles are formed between the first main track girder 1 and the third movable track girder 6 and between the adjacent two movable track girders 4 and 5, 5 and 6. FIG. 2 shows one of the angles as the angle $\alpha$. When a track becomes curved by switching of the switch track girder 3, gaps occur between the main rails 7 of the respective track girders 1, 6, 5 and 4. Intermedial rails 8 are respectively provided to smoothly fill such gaps.

As is obvious from FIG. 5, the main rail 7 is formed in an end portion thereof with a protrusion 9 which is dettachably inserted into a recess 10 formed in an end portion of the intermedial rail 8 correspondingly.

Supporting pieces 11 are formed by forming stepped notches at the end of the main rail 7 and stepped notches 12 are formed in the intermedial rail 8 correspondingly to the supporting pieces 11. Thus, the intermedial rail 8 is supported by the main rail 7 with the supporting pieces 11 and the stepped notchs 12 being engaged with one another. The projection degree with respect to the supporting pieces 11 is decided in order to reliably support the intermedial rail in the bend.

Furthermore, supplementary pieces 19 are mounted on lower surfaces of the main rails 7 and to axially engage with both ends of the rail 8, respectively.

As is obvious from FIGS. 4 and 5, a tie-plate 13 is fixedly secured to an upper surface of the protrusion 9 by screws 14 (only one of which is illustrated) screwed into a screw hole 15 to put the intermedial rail 8 between the supporting pieces 11 and the tie-plates 13, so that the intermedial rail 8 is prevented from deviating vertically from the main rail 7.

Alternatively to that shown in FIGS. 3 and 5, it is possible to form the protrusion 9 on the intermedial rail 8 and the recess 10 in the main rail 7 so that the ends of the main rail 7 are pinched between the supporting pieces 11 of the intermedial rail 8 and the tie-plates 13.

For a magnetic levitating linear motor car, for example, convex guide lines 16 are formed in the lower surfaces of the main rail 7 and the intermedial rail 8, as shown in FIG. 6, for guiding a guide skid 22 of the vehicle structure 21 and for serving a brake disc of a hydraulic brake which is not shown. Further, a reaction plate 17 against a linear motor 23 provided on the vehicle structure 21 is fixedly secured onto an upper surface thereof. An auxiliary skid 20 and auxiliary rail portion 18 for an auxiliary wheel are provided in a side of the reaction plate 17 and the auxilary rail portion 18 is fixed to the track girders 1, 2a, 2b, 4, 5 and 6.

According to the present invention, the vehicle is guided from the main rail 7 to the intermedial rail 8 and then to the other main rail 7.

When the movable track girders 4, 5 and 6 are moved, the bends as shown in FIG. 2 with an angle $\alpha$, for example, 2.4°, are respectively formed between the first main track girder 1 and the third movable track girder 6 and between the adjacent two movable girders 4 and 5, 5 and 6. In such case, an axially relative movement of the intermedial rail 8 to the main rail 7 and a relative rotation thereof thereto around a certain point can be performed as shown in FIG. 7. That is, the angle between the main rail 7 and the intermedial rail 8 becomes $\alpha/2$, for example, 1.2°. This means that the bend of the switch track is reduced to a half at the two positions. Thus, it is possible to avoid a collision of the vehicle structure such as the guide skid 22 and/or hydraulic brake with the switch girder.

When the movable track girders 4, 5 and 6 extend straight, since, even if there is slight vertical or horizontal deviation between the respective track girders, the main rails 7 are mutually connected through the intermedial rail 8, the deviation can be compensated for by the intermedial rail 8 provided therebetween, preventing collision of the vehicle with the main rail 7.

The gaps formed between the main rails 7 when the movable track girders 4, 5 and 6 are moved are filled substantially with the intermedial rails 8, leaving only small and devided gaps between the main rail 7 and the intermedial rail 8, resulting in a smooth guiding of the vehicle. By controlling the movement of the intermedial rail, it is possible to make the gaps at both end portions of the intermedial rail 8 to the main rails 7 equally minimum, resulting in an optimum smooth guiding.

What is claimed is:

1. A multi-articulation switch including a plurality of movable track girders, and means for selectively connecting adjacent movable track girders between one fixed main track girder and a plurality of other fixed track girders, comprising;

main rails fixedly secured onto said movable track girders for guiding a vehicle, respectively;

said main rails forming a curved path when said one fixed main track girder is connected to at least one of said another fixed main track girders; and short intermedial rails continuously positioned between said main rails of one of said movable track girders and said fixed main track girder adjacent thereto and between said main rails of said adjacent movable track girders, for coupling them, both ends of said intermedial rails being continuously engaged with said main rails on said fixed main track girder or said movable track girders with a variable relative angle therebetween, said intermedial rails comprising means for moderating horizontal and vertical deviations between said one main rail and said other main rails.

2. The switch claimed in claim 1, wherein, when the axes of said rails are aligned, said end portions of said main rails and said intermedial rail can be slightly and relatively movable axially and engage each other such that the axes are relatively and mutually rotatable within a predetermined range of angles.

3. The switch claimed in claim 1, wherein at least one notch is formed in said end portions of said main rails to form at least one protrusion and at least one stepped notch is formed in a corresponding end portion of said intermedial rails, so that both ends of said intermedial rails are supported by said main rails.

4. The switch claimed in claim 3, wherein a tie plate is mounted on said main rails such that said plate pinches said at least one stepped notch of said intermedial rails with said at least one protrusion of said main rails.

5. The switch claimed in claim 1, wherein a supporting piece is mounted on a lower surface of said main rails for supporting end portions of corner sides of said intermedial rails.

* * * * *